US009774159B2

(12) United States Patent
Hamm et al.

(10) Patent No.: US 9,774,159 B2
(45) Date of Patent: Sep. 26, 2017

(54) DEFLECTION COMPENSATING PRESS TOOLS

(71) Applicant: Ridge Tool Company, Elyria, OH (US)

(72) Inventors: James E. Hamm, Grafton, OH (US); Richard M. Kundracik, Elyria, OH (US); Robert M. Baracskai, North Ridgeville, OH (US)

(73) Assignee: RIDGE TOOL COMPANY, Elyria, OH (US)

( * ) Notice: Subject to any disclaimer, the term of this patent is extended or adjusted under 35 U.S.C. 154(b) by 233 days.

(21) Appl. No.: 14/598,326

(22) Filed: Jan. 16, 2015

(65) Prior Publication Data

US 2016/0211635 A1 Jul. 21, 2016

(51) Int. Cl.

| | |
|---|---|
| ***B21J 13/04*** | (2006.01) |
| ***H01R 43/042*** | (2006.01) |
| ***B25B 27/10*** | (2006.01) |
| ***B25B 27/14*** | (2006.01) |

(52) U.S. Cl.
CPC ..... *H01R 43/0427* (2013.01); *B25B 27/10* (2013.01); *B25B 27/146* (2013.01)

(58) Field of Classification Search
CPC ..... H01R 43/0427; B21D 5/02; B25B 27/10; B25B 27/146
USPC ..... 72/455
See application file for complete search history.

(56) References Cited

U.S. PATENT DOCUMENTS 2,712,252 A 7/1955 Landis
3,163,105 A 12/1964 Pearson
3,267,717 A * 8/1966 Reischer ..... B30B 15/044 72/416
3,554,000 A 1/1971 Schwab
3,561,252 A * 2/1971 Norton et al. ..... B30B 15/044 100/214
3,852,991 A 12/1974 Poggio
4,018,150 A * 4/1977 Shiokawa ..... B30B 15/044 100/231
4,084,422 A 4/1978 Zilges et al.
4,612,765 A 9/1986 Livesay
(Continued)

FOREIGN PATENT DOCUMENTS

CN 101247904 8/2008
CN 102231467 11/2011

OTHER PUBLICATIONS

Chinese Office Action dated Apr. 27, 2017 for Application No. 201610030814.9 (4 pages).

(Continued)

*Primary Examiner* — David B Jones
(74) *Attorney, Agent, or Firm* — Mark E. Bandy; Rankin, Hill & Clark LLP

(57) ABSTRACT

Press tools and particularly crimp tools having a C-frame tool head are described which are configured such that upon a typical use load, the C-frame head deflects to a position in which mating components or surfaces are aligned. Also described are C-frame heads that utilize a particular deflection compensating engagement connection between a piston and a ram die holder. In addition, various methods of compensating for deflection are described. The use of such configurations, engagement connections, and methods enables such tools to be formed from lighter weight materials and/or to incorporate weight optimization designs.

24 Claims, 13 Drawing Sheets

(56) References Cited

U.S. PATENT DOCUMENTS

| | | | | |
|---|---|---|---|---|
| 4,873,923 | A | 10/1989 | Manning | |
| 5,272,904 | A | 12/1993 | Krumholz | |
| 6,073,525 | A * | 6/2000 | Edwards | B21J 15/28 29/465 |
| 6,768,059 | B1 | 7/2004 | Lefavour et al. | |
| 7,134,314 | B1 | 11/2006 | Peterson et al. | |
| 2016/0211635 | A1 * | 7/2016 | Hamm | H01R 43/0427 |

OTHER PUBLICATIONS

Search Report dated Apr. 27, 2017 for Application No. 201610030814.9 (2 pages).

* cited by examiner

DEFLECTION COMPENSATING PRESS TOOLS

FIELD

The present subject matter relates to press tools and particularly C-frame crimping tools.

BACKGROUND

Electrical contractors use crimpable connectors to form terminations on various copper and aluminum wires. Examples of such connectors are described in UL Standard 486 provided by Underwriters Laboratories, Inc. A variety of crimping tools and crimp profile die geometries are used. Although many different types of dies are used in the field, all dies require a linear application of force to plastically form the connector and wire to the internal geometry of the die. A wide variety of such tools are commercially available from suppliers such as Burndy, Greenlee, and Klauke.

Crimp tools typically require about 53 to 130 kN of linear force and 18 to 32 mm of travel in order to perform a crimping operation. Because of the high amount of work capacity involved, the tools are typically large and heavy. For example, a 130 kN tool may weigh as much as 15 pounds. Electrical contractors use the tools in a variety of applications which require that they hold the tool in one hand. Because of this, weight is a primary concern of users. Thus, it is highly desirable to design a tool which is optimized for weight in order to increase ease of use of the tool.

Generally, these crimp tools utilize a C-frame crimping head. The C-frame crimping heads are subjected to high stresses during a crimping operation and thus are typically formed from a high tensile strength material, for example hardened alloy steel, and require a large cross section. The weight of a C-frame crimping head is relatively heavy and optimization efforts are focused on this component.

As crimping tools are presently configured, optimization of the C-frame head is limited by two constraints. One constraint is that the C-frame head must not be allowed to deflect at the open end. Such deflection results in displacement of the dies in a nonlinear or substantially nonlinear manner. In many instances, the dies are displaced away from a generally linear travel path during a crimping operation. In such an event, the dies may become misaligned and the crimp profile may be distorted. In the industry, a crimp is generally considered complete when both ends of the crimp inserts or dies are in contact with each other. The noted problems with deflection can prevent this from occurring, particularly with large connectors. Additionally, the stresses on mating parts are increased and mechanical failures may result. Another constraint is that the maximum stress in the C-frame head must be limited and controlled so as to prevent premature failure and ensure an appropriate failure mode.

Due to the geometry of the components and applications of the loads, the deflection constraint is more restrictive. For example, a C-frame head optimized only for stress has been shown to be lighter. However, a lighter and more flexible C-frame head has also been shown to cause damage to mating parts as a result of the deflection.

Accordingly, a need exists for a C-frame head, such as used in a pressing tool or crimping tool, which avoids these problems, and particularly for such a tool which exhibits a lightweight design, yet which avoids or at least reduces the potential of damage resulting from deflection.

SUMMARY

The difficulties and drawbacks associated with previous approaches are addressed in the present subject matter as follows.

In one aspect, the present subject matter provides a C-frame tool head defining a proximal end and an opposite distal end, and an extension axis corresponding to movement of a ram, piston, or force producing member. The tool head comprises a body portion, and a hook member extending from the body portion. The hook member defines a crimp face directed toward the proximal end of the tool head. The crimp face defines a center axis that bisects the crimp face. Upon the tool head being in an unloaded state, the center axis is spaced from the extension axis, and upon being in a loaded state, the center axis is displaced towards the extension axis.

In another aspect, the present subject matter provides a C-frame tool head and at least two crimping inserts. The tool head defines a proximal end and an opposite distal distal end. The tool head comprises a body portion, and a hook member extending from the body portion. The hook member defines a crimp face directed toward the proximal end of the tool head. The tool head also comprises a first crimping insert configured to be received along the crimp face. The first crimping insert defines a first end and a second end. The tool head additionally comprises a second crimping insert defining a first end and a second end. The second crimping insert is positionable with the first crimping insert to thereby form a crimping profile. Upon positioning of the first and the second crimping inserts such that one of the first and the second ends of the first crimping insert contacts one of the first and the second ends of the second crimping insert, and the tool head being in an unloaded state, an opposite end spacing is defined between the other ends of the first crimping insert and the second crimping insert. Upon the tool head being in a loaded state, the other ends of the first crimping insert and the second crimping insert contact each other and the opposite end spacing is zero.

In still another aspect, the present subject matter provides a press tool comprising a frame including a C-frame tool head defining a work region and a first crimp face. The tool also comprises a hydraulic cylinder supported by and affixed to the frame. The tool also comprises a piston movably disposed in the cylinder. The piston defines a piston face and an opposite distal end. The distal end extends outward from the hydraulic cylinder. The tool additional comprises a ram die holder engaged with the distal end of the piston. The ram die holder includes a second crimp face. The ram die holder is accessible in the work region defined by the tool head. Upon application of a crimping load to the first and second crimp faces by the piston, the tool head is configured to deflect to an extent such that the first and second crimp faces are aligned.

In yet another aspect, the present subject matter provides a press tool comprising a frame including a C-frame head defining a work region, a linearly displaceable piston having a distal end, a piston tip engaged with the distal end of the piston, and a ram die holder engaged with the piston tip. The ram die holder is accessible in the work region defined by the C-frame head. The ram die holder is movably affixed to the piston tip. The piston tip defines a first arcuate face surface directed toward the ram die holder, and the ram die holder defines a receiving region with a second arcuate face surface. The first arcuate face surface of the piston tip contacts the second arcuate face surface of the ram die holder, and the first arcuate face surface is continuous and free of apertures.

In still another aspect, the present subject matter provides a method of compensating for deflection occurring in a C-frame head of a press tool during a pressing operation. The method comprises providing a press tool including a C-frame head and a plurality of dies. The method also comprises configuring the C-frame head such that upon application of a load as would be applied during the pressing operation, the tool head deflects to a position such that the plurality of dies are aligned to thereby enable full die closure.

As will be realized, the subject matter described herein is capable of other and different embodiments and its several details are capable of modifications in various respects, all without departing from the claimed subject matter. Accordingly, the drawings and description are to be regarded as illustrative and not restrictive.

DETAILED DESCRIPTION OF THE EMBODIMENTS

Figure 1:
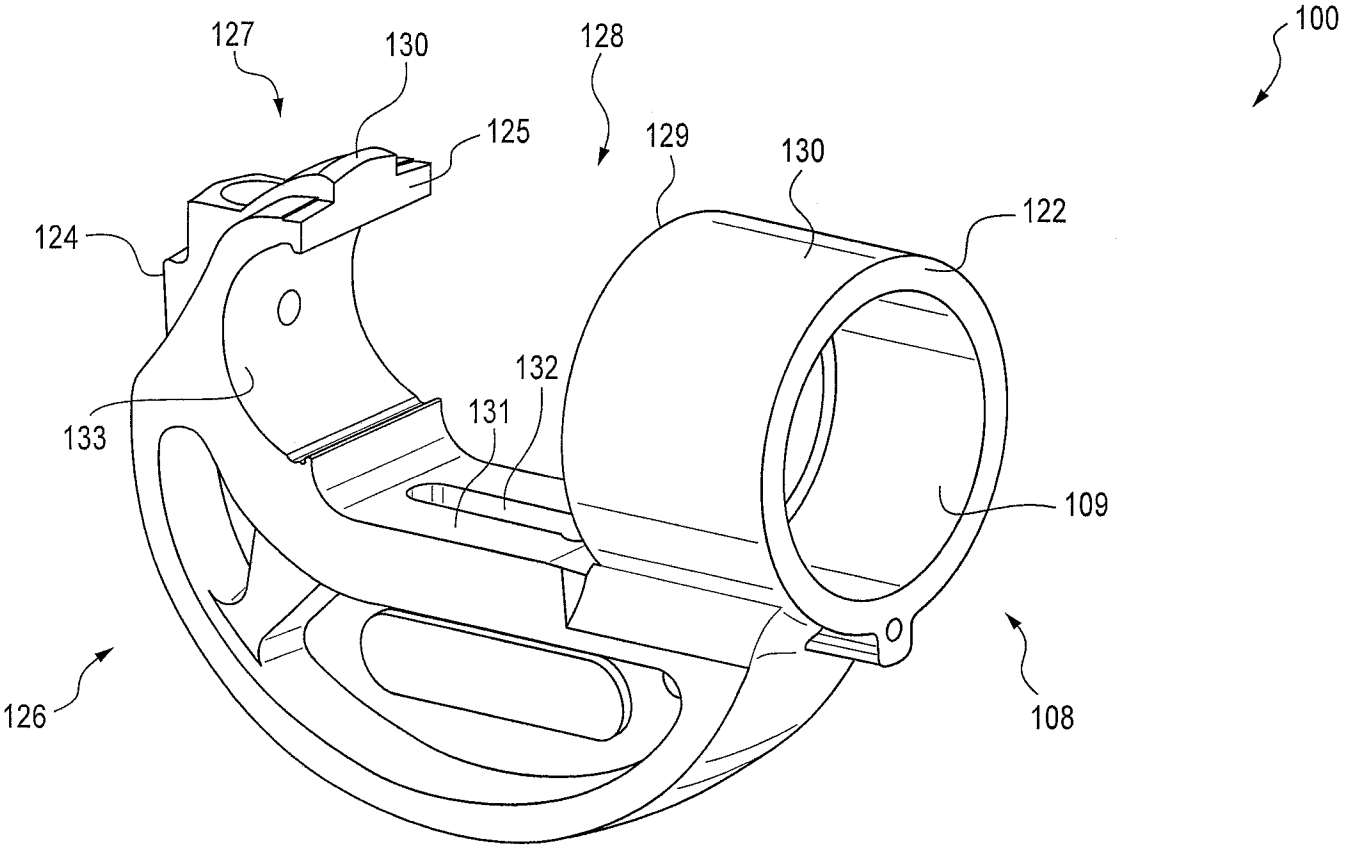
FIG. 1 is a perspective schematic view illustrating a tool head of a conventional crimp tool.

The present subject matter provides strategies and components embodying such strategies which compensate for deflections occurring in a C-frame shaped tool head. Generally, in one aspect of the present subject matter, a C-frame tool head is configured such that upon application of loads or forces associated with typical use of the tool and tool head, the C-frame tool head compensates for such loads or forces by deflecting to particular extents and at particular locations along the tool head such that mating components of the tool head are appropriately aligned, positioned, and/or oriented. The present subject matter also provides C-frame press or crimp tools utilizing such assemblies.

The present subject matter also provides deflection compensating engagement assemblies between a piston and a ram die holder in a C-frame press or crimp tool. Such assemblies allow greater deflection within the stress limits of the C-frame tool while maintaining a quality crimp. The present subject matter also provides C-frame press or crimp tools utilizing such assemblies.

The present subject matter tools embodying such strategies and/or using such assemblies can thus be further optimized for weight and crimp quality as compared to existing tools. The present subject matter additionally provides methods of using the noted strategies and/or assemblies. All of these aspects are described in greater detail herein.

In particular embodiments, the present subject matter provides tools with C-frame shaped crimping heads, and particularly those that hold crimping dies such as crimping dies for DIN 46235 connectors. The term "C-frame" or "C-frame head" as used herein refers to the working end or "head" of a press or crimp tool which is characterized by a closed end and an open face typically located along a frontwardly directed region of the head. A working region is generally defined between the closed end of the C-frame head and at least one movable die which is displaced by a piston or other powered member. The terms "press tool" and "crimp tool" are used interchangeably herein as the present subject matter engagement assemblies will find wide application in such tools and related or similar tools. Similarly, the terms "dies" and "inserts" are used interchangeably herein. The term "deformation" is used herein to describe a dimensional change to various tool heads and/or tool components. It will be understood that the term "deformation" refers to elastic deformation that occurs upon application of loads or forces. The term "deformation" as used herein does not refer to, nor include, plastic deformation.

Although the present subject matter is generally directed to hydraulically operated press and/or crimp tools, the present subject matter also includes other tools which may not necessarily utilize hydraulics or liquid displacement pumps to effect displacement of a piston or crimping component. For example, the present subject matter can also be implemented in tools using a powered linearly displaceable member or like components. Such tools may use electrically powered mechanical assemblies or other configurations. The present subject matter can also be implemented in manually powered press or crimp tools. A wide variety of press tools, typically hydraulically operated, are known and described in patents such as U.S. Pat. Nos. 6,035,775; 6,244,085; 6,510,723; and 7,124,608 for example. Examples of C-frame heads are shown and described in U.S. Pat. Nos. 5,062,290; 4,292,833; 6,220,074; and 6,619,101.

In certain embodiments, the present subject matter provides a press tool that is configured such that during use and upon application of a load to a die holder and/or workpiece, i.e., such that the tool is in a loaded state, the tool head deflects to a proper position or orientation at which crimping or other mating components are aligned and/or appropriately positioned relative to one another. In an unloaded state, the tool or tool components may appear to be misaligned, or in an improper position or orientation. The present subject matter provides various embodiments in accordance with this strategy.

In one embodiment, an offset crimping face is provided such that upon application of a load corresponding to a typical operation such as crimping, the crimp face deflects to an aligned position. The crimping face can be provided in a tool head, other tool component, and/or via a combination of a tool head and tool accessories.

In another embodiment, if using crimping inserts with the tool, the inserts are shaped or configured so as to define a gap between the crimping inserts or crimping surfaces at an unloaded state. Upon application of a load corresponding to a typical operation such as crimping, the C-frame deflects thereby causing the inserts to translate and/or rotate so that the gap is eliminated or at least substantially so, and the crimping inserts and/or surfaces are aligned.

In still another embodiment, a crimp tool having a tool head is configured so that a crimping face has a center axis that is, at an unloaded state, spaced from an axis of piston or ram extension. Upon application of a peak force or load corresponding to a typical operation such as crimping, the crimping face deflects toward, and in many embodiments into, alignment with the extension axis.

In yet another embodiment, a crimp tool having a tool head is configured so that a crimping face has a center axis that is, at an unloaded state, spaced from an axis of piston or ram extension as previously described. Upon application of a load corresponding to a typical operation such as crimping, the crimping face deflects toward alignment with the extension axis. The tool head can be configured such that alignment between the noted axes occurs at any point during a typical crimping such as for example at 20%, 30%, 40%, 50%, 60%, 70%, 80%, or 90%, or any other point between 0% to 99% of peak force application. In such versions of the present subject matter, the tool head would likely be in a misaligned configuration at an end or peak force point of a crimp, e.g., 100% of force application. Thus, the present subject matter includes tool heads that are configured to be fully compensated such that the noted axes are aligned at full load, and tool heads that are configured to be partially compensated such that the noted axes are aligned at some percentage of full load.

In many embodiments described herein, a tool head and/or its related components are configured such that upon application of a load as would be applied during a typical pressing or crimping operation, the tool head and/or the noted components deflect to a position and/or state such that the tool head and/or associated components are aligned so as to enable a proper and/or full die closure. Nonlimiting examples of loads applied during a typical pressing or crimping operation are from about 20 kN to abut 180 kN, more particularly from about 50 kN to about 130 kN, and in certain applications from about 70 kN to about 130 kN.

The present subject matter also provides various methods of using and/or implementing the deflection compensating tool heads. Generally, the methods provide a strategy of compensating for deflection occurring in a C-frame head of a press tool during operation of such tool. The methods comprise providing a press tool including a C-frame head that is configured such that upon application of a load, the tool head deflects to a proper position or orientation at which components are aligned and/or appropriately positioned relative to one another. The methods can also relate to incorporating a tool head as described herein in a press tool.

In certain embodiments, the present subject matter also provides unique engagement assemblies between a piston and a ram die holder utilized in a press or crimp tool. The various engagement assemblies of the present subject matter compensate for deflection occurring within the press or crimp tool and particularly within the C-frame head during pressing or crimping. The ram die holder is movably affixed to an end of the piston by the engagement assembly. During a crimping operation, the piston moves along an extension axis. The ram die holder moves or articulates to correspond to a range of deflections occurring in the C-frame head. In this manner, the articulated assembly between the ram die holder and the piston compensates for deflection which may be occurring in the C-frame head. The ram die holder is movably affixed to the piston end so that the ram die holder can be articulated to a plurality of different positions relative to the extension axis. In certain embodiments, the engagement assemblies include a pivoting connection to allow for guided or limited articulation within a plane between the piston and the ram die holder. The extent of such articulation generally corresponds to the extent of deflection occurring in the C-frame head during a crimping or pressing operation. In particular embodiments, a semi-cylindrical recess or socket is formed on the ram die holder. This socket is engaged with a semi-cylindrical end formed on the piston. In still other versions in which articulation is not limited within a plane, the mating surfaces of the ram die holder and the piston may be semi-spherical. Because of the semi-cylindrical or semi-spherical configuration, rotation and/or arcuate movement between the components is allowed while maintaining the maximum possible surface contact between mating parts.

In particular embodiments, a distal end of the piston may be provided or "tipped" with an insert having a particular geometry. Nonlimiting examples of such geometry include arcuate, convex, concave, semi-cylindrical, and semi-spherical. The piston tip or end can be formed from a material able to withstand high stresses and which is durable and wear-resistant, for example hardened alloy steel. This enables a remaining majority of the piston to be formed from a lighter weight and/or less costly material, for example aluminum alloy. The present subject matter includes assemblies of piston ends without such tips, but which are configured to exhibit the noted geometries. In such embodiments, the ram die holder is configured to correspondingly receive the configured distal end of the piston.

In certain versions, pins, screws, and/or other fasteners extend entirely or partially through the ram die holder and extend into a channel or aperture at the tip or end of the piston. The engagement configuration of these components is such that during the application of force such as from the piston to the ram die holder, the loads are transferred entirely through contact between the mating surfaces. However, as the piston retracts to a starting position after completion of a crimping operation, the pins or screws retain the ram die holder to the piston and cause the entire assembly to retract.

The present subject matter also provides various methods of using and/or implementing the engagement assemblies. Generally, the methods provide a strategy of compensating for deflection occurring in a C-frame head of a press tool during operation of such tool. The methods comprise providing a press tool including a C-frame head defining a work region, a piston movably displaceable along an extension axis, and a ram die holder associated with the piston and accessible in the work region defined by the C-frame head. The methods also comprise incorporating an engagement assembly between the piston and the ram die holder such that the ram die holder can be articulated to a plurality of different positions relative to the extension axis. The engagement assembly can be in accordance with any of the engagement assemblies described herein.

Additional details and aspects of the deflection compensating C-frame heads and the deflection compensating engagement assemblies of the present subject matter are described herein. Additional details and aspects of tools using these C-frame heads and/or assemblies, and related methods are also described herein.

Deflection Compensating C-Frame Heads

In this aspect of the present subject matter, a C-frame tool head is provided which in an unloaded state may appear to exhibit a misaligned configuration, and in a loaded state exhibits an aligned configuration or a misaligned configuration in an opposite direction. It will be understood that when in an unloaded state, the extent of misalignment may not be visibly apparent. However, the misalignment will be present. The term "loaded state" as used herein refers to the dimensional state, i.e., size and shape, of the tool head upon application of a load that corresponds to a typical maximum use load of the tool head. For example, for a C-frame tool head used in a crimping tool rated at 130 kN (about 12 tons), upon application of a 130 kN force to the tool head, i.e., a typical "crimping load," the tool head is in a loaded state and deflects to a dimensional state that is different than the dimensional state of the tool at an unloaded state. The differences between the tool head in a loaded state and the tool head in an unloaded state depend upon a variety of factors including the shape of the tool head, and physical properties of the tool head material such as the modulus of elasticity of the material forming the tool head. The term "unloaded state" as used herein refers to the dimensional state, i.e., size and shape, of the tool head in a load-free state at which no external loads are applied.

FIG. 1 is a perspective schematic view illustrating a tool head 100 of a conventional crimp tool (not shown). The tool head is in the form of a C-frame tool head that defines a proximal end 122 and an opposite distal or "head" end 124. The tool head 100 includes a body portion 126. The tool head 100 also defines a frontwardly directed face 130. The tool head 100 additionally defines an alignment track 132. The alignment track 132 extends along a frontwardly directed rear wall 131 of the tool head 100 and is accessible in the work region 128. The tool head 100 also defines a crimp face 133 accessible in the work region 128. The work region 128 is defined at least in part by the crimp face 133 and the rear wall 131. The tool head 100 also includes a hook member 127 extending from the body portion 126 that terminates at a first access face 125. An opposing second access face 129 is directed toward the distal end 124. The faces 125 and 129 provide access to the work region 128. The tool head 100 also includes provisions for affixing the tool head to a corresponding tool component which provides an extendable piston or ram. The provisions can be in the form of a threaded receiving end 108 which includes threads 109.

Upon affixment of the tool head 100 to a corresponding tool component or within a fixture having a force producing member, upon extension of a piston, ram, or force producing member and application of a designated load to the crimp face 133 of the tool head 100, the tool head undergoes deflection from its initial unloaded state.

Figure 2:
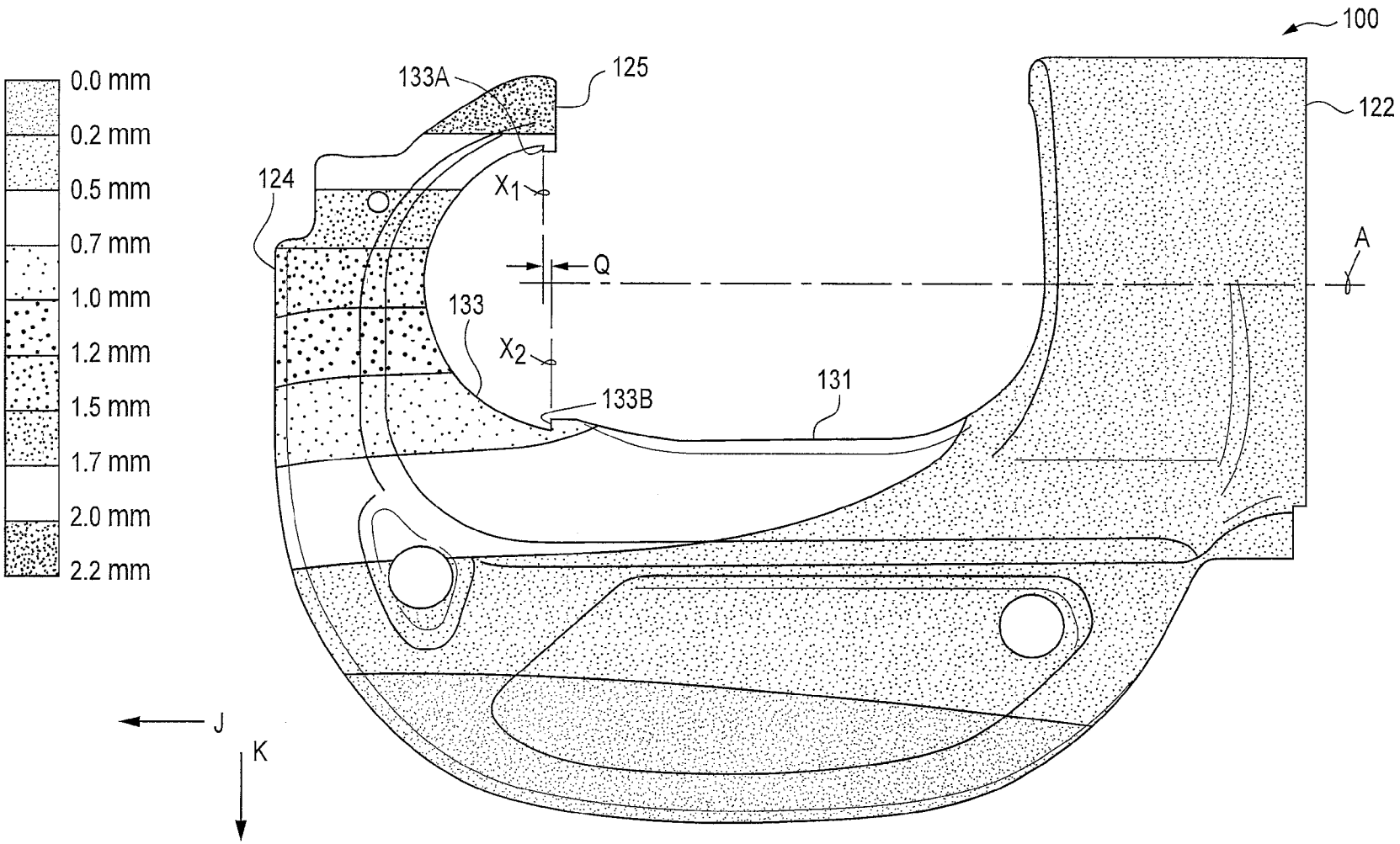
FIG. 2 is an illustration of the tool head depicted in FIG. 1 showing deflection in direction J upon application of a typical load during use of the tool head.
Figure 3:
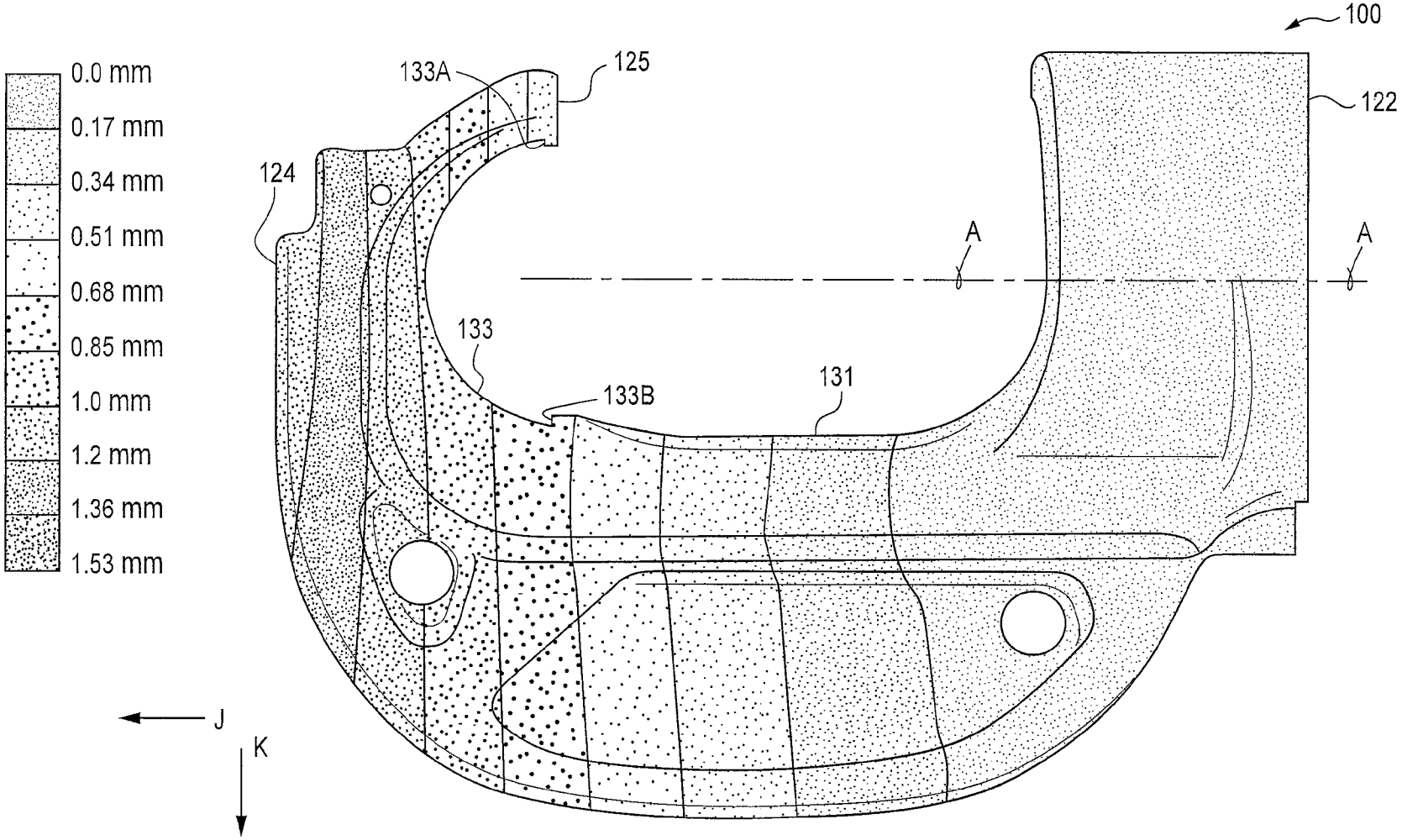
FIG. 3 is an illustration of the tool head shown in FIG. 1 illustrating deflection in direction K upon application of a typical load during use of the tool head.

FIGS. 2 and 3 illustrate deflection of the tool head 100 when the tool head is in a loaded state. The crimp face 133 is arcuate or substantially so and more particularly concave, and typically extends between a first ledge 133A located near the first access face 125, and a second ledge 133B adjacent the rear wall 131. In an unloaded state of the tool head (not shown in FIG. 2 or 3), the first and second ledges 133A and 133B are generally aligned with each other such that the ledges are located along a line that is perpendicular to an axis of extension A of a piston or ram upon affixment of the tool head to a corresponding tool component.

Upon placing the tool head 100 in a loaded state as shown in FIG. 2, the first and second ledges 133A and 133B become misaligned as a result of deflection occurring in the tool head 100. Specifically, various regions of the tool head 100 are deflected and undergo dimensional deformation such that the ledges 133A and 133B do not extend along a common line that is perpendicular to the axis of extension axis A. Instead, in the noted loaded state, the ledge 133A extends generally along a line $X_1$ which is generally transverse to the axis A; and the ledge 133B extends along a line $X_2$ which is transverse to the axis A and which is different and/or distinct from line $X_1$. As illustrated in FIG. 2, the lines $X_1$ and $X_2$ are spaced apart from one another by an overall net deflection Q. In the noted loaded state, the line $X_1$ is closer to the distal end 124 of the tool head 100 than the line $X_2$, as measured along the extension axis A.

Typically during loading, the first ledge 133A is displaced in the directions of arrow J and arrow K. And, typically the second ledge 133B is also displaced in the directions of arrow J and arrow K, however to a lesser extent. FIGS. 2 and 3 graphically depict such deflections. The extent of the deflections depends upon a variety of factors as previously noted. However, upon application of a 130 kN load to a tool head formed from AISI 4140 Steel for example, having the following properties as noted in Table 1, the first ledge 133A undergoes a maximum deflection in the direction of arrow J of about 2.2 mm. The second ledge 133B undergoes a maximum deflection in the direction of arrow J of about 0.3 mm. It will be understood that this is a representative example and the maximum deflection in the direction of arrow J could be greater than or less than the deflection depicted in the figure. FIG. 3 illustrates typical deflection of the tool head in the direction of arrow K.

TABLE 1

Approximate Physical Properties of 4140 Steel

| Modulus of Elasticity, E (psi) | Poisson's Ratio | Tensile Yield Strength (psi) | Ultimate Tensile Strength (psi) |
|---|---|---|---|
| $2.97 \times 10^7$ | 0.29 | 190,000 | 207,000 |

The scales included in FIGS. 2 and 3 depict typical dimensional deformation of regions of the tool head 100 upon application of the noted 130 kN load to the crimp face 133. The indicated values are dimensions in millimeters with deflection occurring to the left, i.e., in the direction of arrow J, and downward, i.e., in the direction of arrow K. FIGS. 2 and 3 illustrate that upon typical loading of the tool head such as during crimping, various structures, regions, and in particular the crimp face 133, deflect to different locations as compared to a state of no loading of the tool head. The new locations of the noted structures, regions, and crimp face detrimentally effect crimping or other pressing operation(s).

Figure 4A:
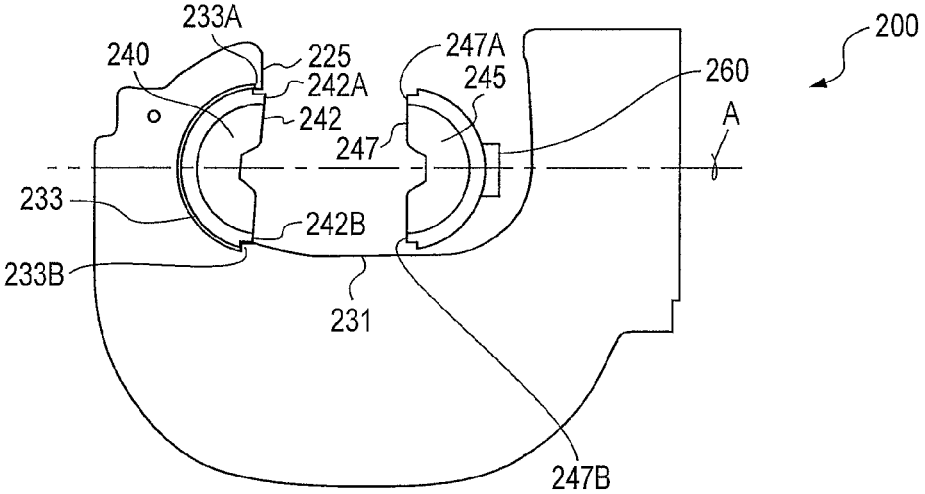
FIGS. 4A-4D are schematic illustrations of an embodiment of a deflection compensating tool head in accordance with the present subject matter.
Figure 4B:
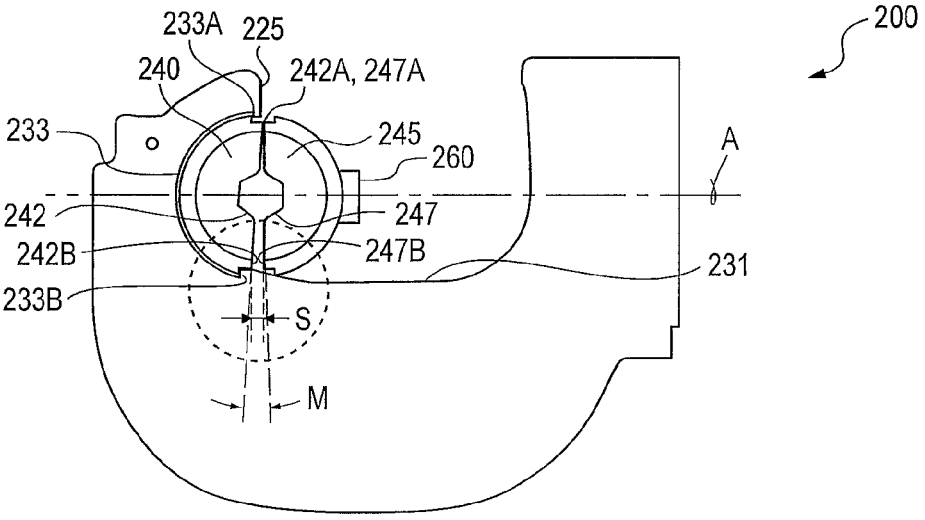
Figure 4C:
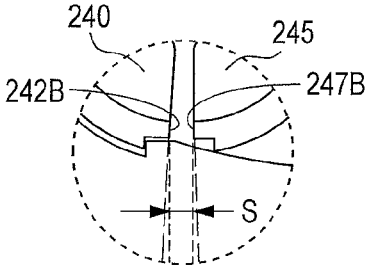
Figure 4D:
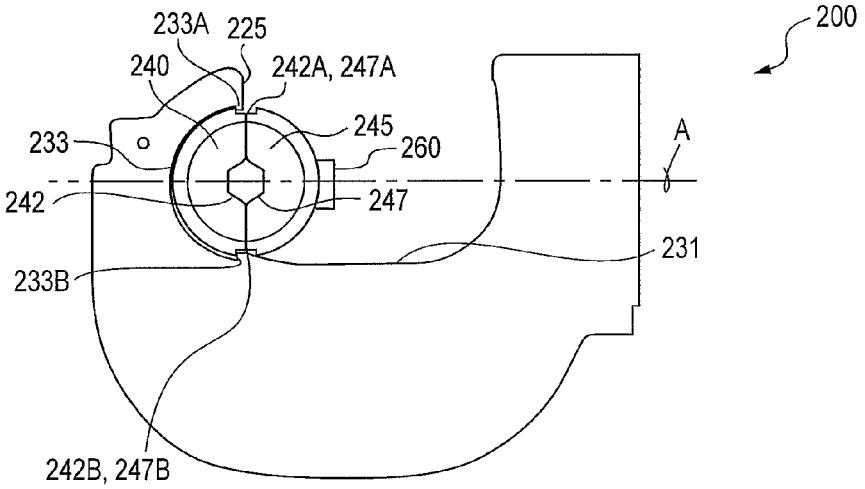

FIGS. 4A-4D are side schematic views showing an embodiment of a tool head 200 in accordance with the present subject matter depicting the tool head 200 in an unloaded state (FIG. 4A), a partially loaded state (FIG. 4B), and a fully loaded state (FIG. 4D). The tool head 200 may include some or all of the various structural features of the previously noted tool head 100, such as for example an access face 225 and first and second ledges 233A and 233B, respectively. However, it will be appreciated that the present subject matter tool heads do not require such features. For example, the present subject matter includes tool heads which are free of the ledges 233B and 233B. The present subject matter includes a wide array of tool head configurations. FIGS. 4A-4D also illustrate two dies or crimping inserts 240 and 245. The die 240 is received in and supported by a crimp face 233. The die 245 is supported by a movable ram die holder 260. The die 240 defines a die surface 242 and the die 245 defines a die surface 247. Upon appropriate placement of the dies 240, 245 in the tool head 200, the die surface 242 is directed toward the die surface 247. The die surface 242 extends between a first end location 242A and a second end location 242B. The die surface 247 extends between a first end location 247A and a second end location 247B. The first end locations 242A and 247A are typically aligned or directed toward one another and are located proximate the first access face 225. The second end locations 242B and 247B are typically aligned or directed toward one another and are located proximate the rear wall 231. As noted, the second die 245 is supported and/or retained by die holder 260. The die holder 260 transmits force from a linearly displaceable piston or ram (not shown). The dies 240, 245 and particularly their corresponding die surfaces 242, 247 form a crimping profile.

During displacement of the die 245 toward the die 240, the die head 200 is configured such that the first end locations 242A and 247A of the dies 240, 245 respectively, contact one another prior to contact between the second end locations 242B and 247B. This state is illustrated in FIG. 4B. Upon initial contact between the first end locations 242A and 247A, an opposite end spacing S is present between the other ends of the dies, i.e., between the second end locations 242B and 247B. FIG. 4C is a detail of the dashed region in FIG. 4B revealing the spacing S. Thus, in the assembly described in the referenced figures, the opposite end spacing S is an indication of the deflection compensating configuration of the tool head 200, when the tool head is in an unloaded state. Although force has been applied to the second die 245 resulting in its linear displacement toward the first die 240, at this juncture no external loads are applied to the tool head 200 which would result in deformation of the tool head. Representative and nonlimiting values for the opposite end spacing S range from about 3 mm to about 0.1 mm, in certain embodiments from 2 mm to 0.5 mm, and in a particular embodiment from 1.4 mm to 0.8 mm.

Another indication of the deflection compensating configuration of the tool head 200 is the presence of a bias angle M defined between faces of the dies 240 and 245. Specifically, the bias angle M is defined as the angle between a first line intersecting the end locations 242A and 242B of the first die 240 and a second line intersecting the end locations 247A and 247B of the second die 245, upon initial contact between the end locations 242A and 247A. Similarly, reference to the bias angle is when the tool head is in an unloaded state. Representative and nonlimiting values for the bias angle M range from about 15 degrees to about 0.1 degrees, in certain embodiments from 10 degrees to 1 degree, and in a particular embodiment from 5 degrees to 1 degree.

FIG. 4D illustrates the tool head 200 and dies 240, 245 upon deflection of the tool head 200 and additional displacement of the die 245 toward the die 240 and elimination of the opposite end spacing S and the bias angle M. Upon elimination of the opposite end spacing S, the opposite end spacing is zero and the bias angle M is zero. Upon full or complete die closure, the second end locations 242B and 247B contact each other. Upon full or complete die closure, the force which is applied to the die 245 by a piston or ram (not shown) may be any level of force that is less than peak force, such as for example 70%, 80%, or 90%, or any other percentage of peak force. In certain embodiments, the tool head 200 and/or dies 240, 245 can be configured such that upon full or complete die closure, the force which is applied to the die 245 is the peak force.

Figure 5A:
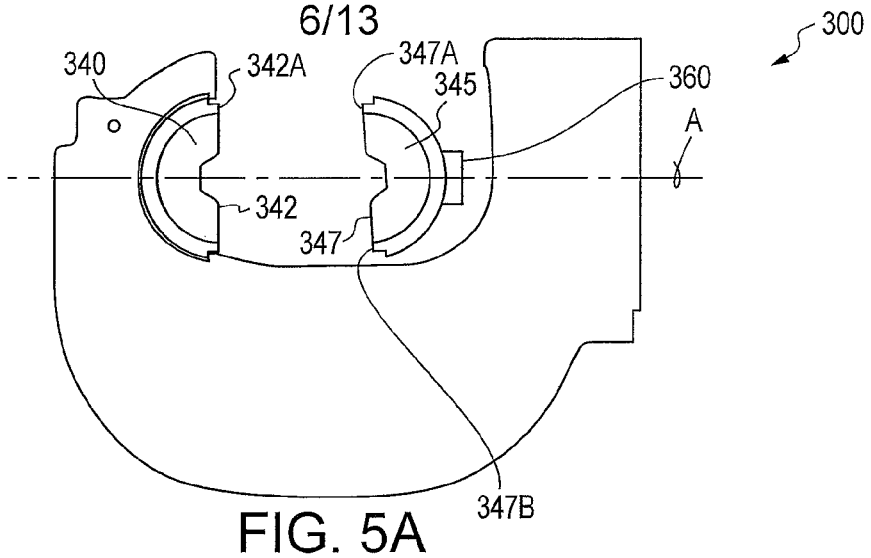
FIGS. 5A-5C are schematic illustrations of another embodiment of a deflection compensating tool head in accordance with the present subject matter.
Figure 5B:
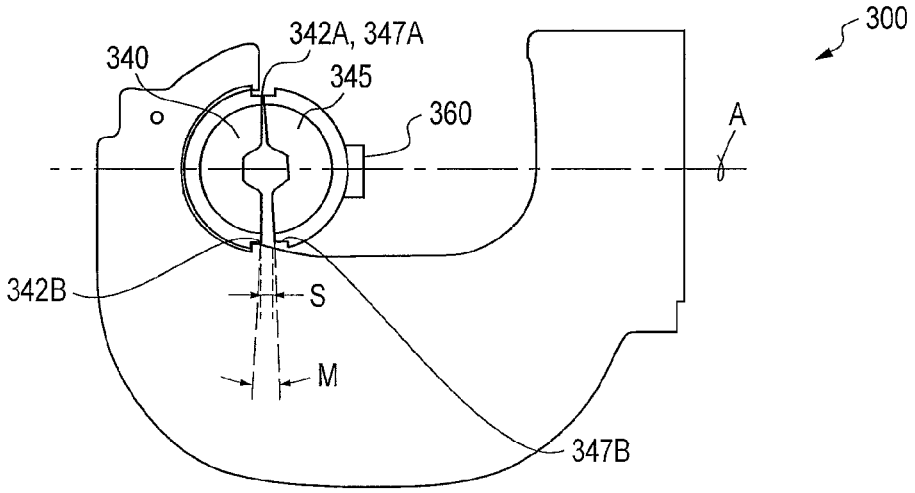
Figure 5C:
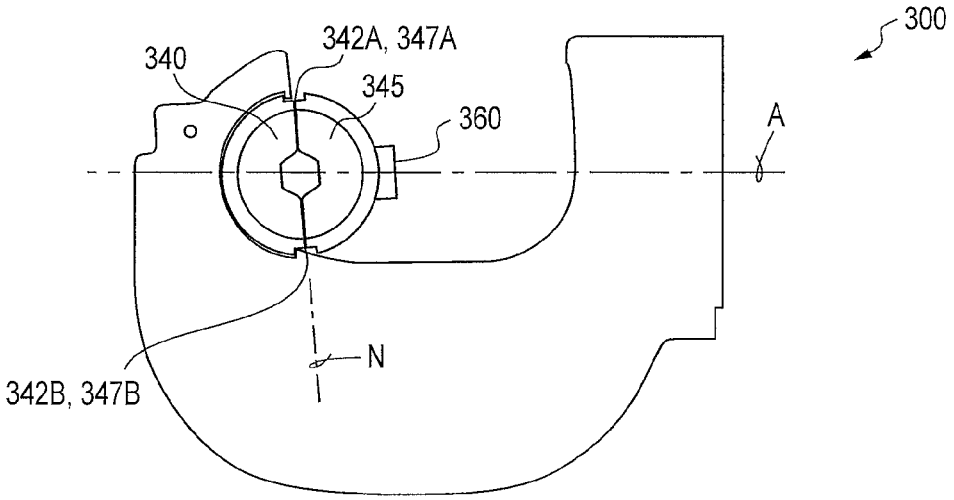

FIGS. 5A-5C illustrate another tool head 300 in accordance with the present subject matter. The tool head 300 is shown with dies or crimping inserts 340 and 345, corresponding to previously described tool head 200 and dies 240 and 245 of FIGS. 4A-4D. The description of the tool head and dies of FIGS. 5A-5C generally corresponds to that provided in conjunction with FIGS. 4A-4D. However, the tool head 300 includes a ram die holder 360 which is configured such that the ram die holder 360 serves to at least partially compensate for deflection occurring in the tool head 300. Thus, in the embodiment depicted in FIGS. 5A-5C, deflection compensation is achieved by the ram die holder 360 or a combination of the configuration of the tool head 300 and the ram die holder 360.

Specifically, referring to FIG. 5C, the dies 340 and 345 reach full closure at either peak force or at some force level less than peak force. Upon application of peak force, the dies 340, 345 may be rotated slightly such that a line N intersecting the contacting ends 342A, 347A and the contacting ends 342B, 347B is not perpendicular to the axis A of ram extension. And thus the line N corresponding to the orientation of the die faces is oriented at an angle of less than 90° with respect to axis A. It will be appreciated that the deflection compensating characteristics of the tool head 300 and ram die holder 360 may be exhibited in a variety of other ways.

It will be appreciated that the present subject matter is not limited to deflection compensating C-frame heads as depicted in FIGS. 4A-4C and 5A-5C, and/or do not necessarily require the tool head to include the noted first and second ledges such as 233A and 233B. Instead, the present subject matter includes tool heads that are free of such ledges, and which may instead include other projections, recesses, or combinations thereof which are located along a crimp face.

Figure 6C:
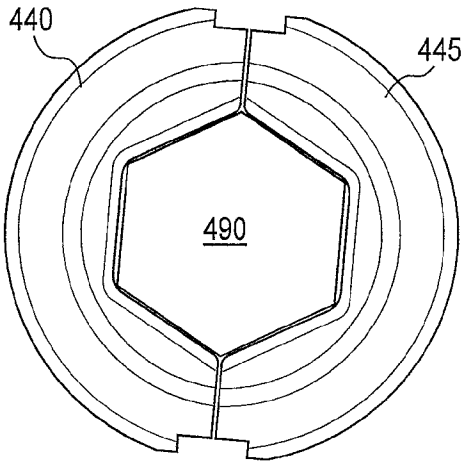
FIGS. 6A-6C illustrate a pair of dies during a typical pressing or crimping operation.
Figure 6B:
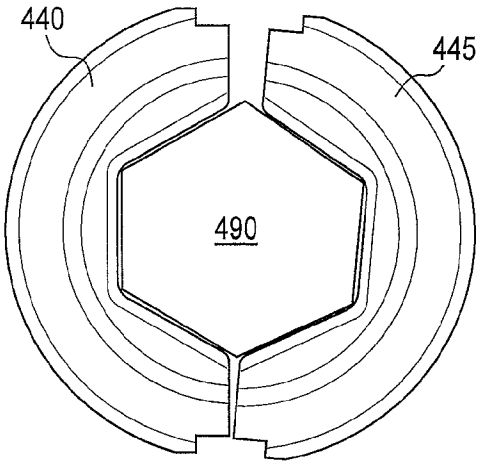
Figure 6A:
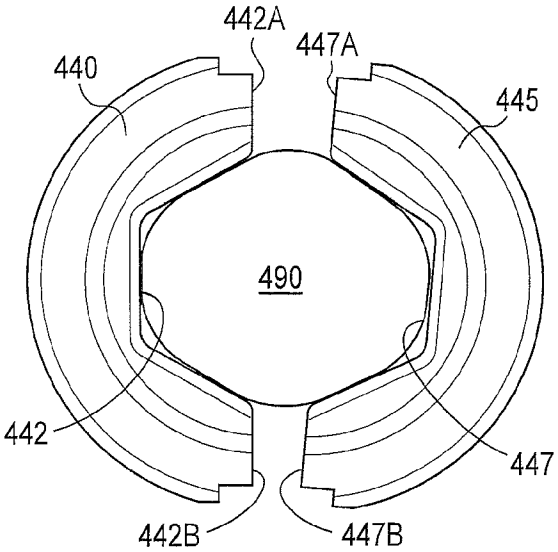

It will be understood that the present subject matter includes a wide array of assemblies and tool head configurations which compensate for deflection. For example, FIGS. 6A-6C illustrate a pair of dies or crimping inserts 440 and 445. As previously described, the insert 440 defines a die face 442 extending between ends 442A and 442B. The insert 445 defines a die face 447 extending between ends 447A and 447B. FIG. 6A illustrates initial engagement of a fitting 490 for example by the dies 440 and 445. In many conventional tool systems that do not include the deflection compensating features of the present subject matter, full or complete die closure may not occur or at least be significantly hindered. As will be appreciated, in a conventional crimping tool, prior to initiation of a crimping operations, the die faces 442 and 447 are symmetrically arranged relative to one another and in particular the face ends 442A and 447A, and face ends 442B and 447B, are parallel with each other. As the crimping operation is performed, the die(s) are displaced toward each other (or one die is moved toward the other die which remains stationary). FIG. 6B illustrates a peak load state that can typically occur in a conventional tool system. At this state, deflection of the tool head (not shown) causes the die 445 to rotate clockwise (as seen in FIG. 6B). Thus, a gap or spacing exists between the die ends 442A and 447A. If the tool system is capable of delivering greater amounts of force to the die(s), the state shown in FIG. 6C can eventually be reached. FIG. 6C illustrates a state of full or complete die closure. Generally, full or complete die closure is defined as a state of the dies such as dies 440 and 445, in which full contact between opposing die faces occurs on both sides of the crimp or fitting, such as fitting 490. However, many tools are limited in the amount of force that can be delivered during a crimping or pressing operation. And so, the state shown in FIG. 6C may not be obtainable in such conventional tools.

Using the deflection compensating strategies, assemblies, and tool heads as described herein, in certain embodiments partial die closure occurs at a level of force that is less than peak force. As previously noted, without incorporation of the deflection compensating strategies, assemblies and/or tool heads, a conventional tool may reach the peak force at the state shown in FIG. 6B, in which the dies are not fully closed.

Using the strategies, assemblies and tool heads as described herein, full die closure is possible, and in many embodiments, occurs before peak force is obtained. In many embodiments, the force required to reach full die closure is from about 10% to about 99%, in particular embodiments from about 70% to about 95%, and in certain embodiments about 85% of the peak force reached (such as when one or more internal hydraulic pressure relief valves open in the tool and the crimping or pressing operation is terminated). Thus, in such embodiments, full die closure is reached at a force that is less than the peak force of the tool.

The present subject matter also includes crimping inserts which upon being placed in a loaded state, are configured to deform such that their crimping surfaces are aligned or otherwise appropriately positioned relative to one another. In certain applications, proper positioning is completely closing the inserts such that their ends contact each other. In an unloaded state, the crimping inserts may appear to be misaligned, or in an improper position or orientation.

It will be appreciated that the present subject matter includes a wide array of inserts, insert shapes and configurations, and orientations between the inserts and the tool head. Thus, in no way is the present subject matter limited to the particular arrangement and/or configuration of inserts depicted in FIGS. 4A-4D, 5A-5C, 6A-6C. For example, the present subject matter includes configurations in which the opposite end spacing S is present between the other ends of the inserts. Furthermore, the opposite end spacing or gap between inserts can be at other locations of the collection of inserts. And, the opposite end spacing can be in the form of a sum of two or more gaps or spaces between inserts.

The present subject matter also includes a tool head that is configured with a crimp face which defines a center axis that, at an unloaded state of the tool head, is spaced from an axis of extension of a piston, ram, or other force producing member. Upon placing the tool head in loaded state, deflection occurs such that the center axis becomes aligned with the extension axis, which typically results in the axes becoming parallel with one another or becoming collinear.

Figure 7:
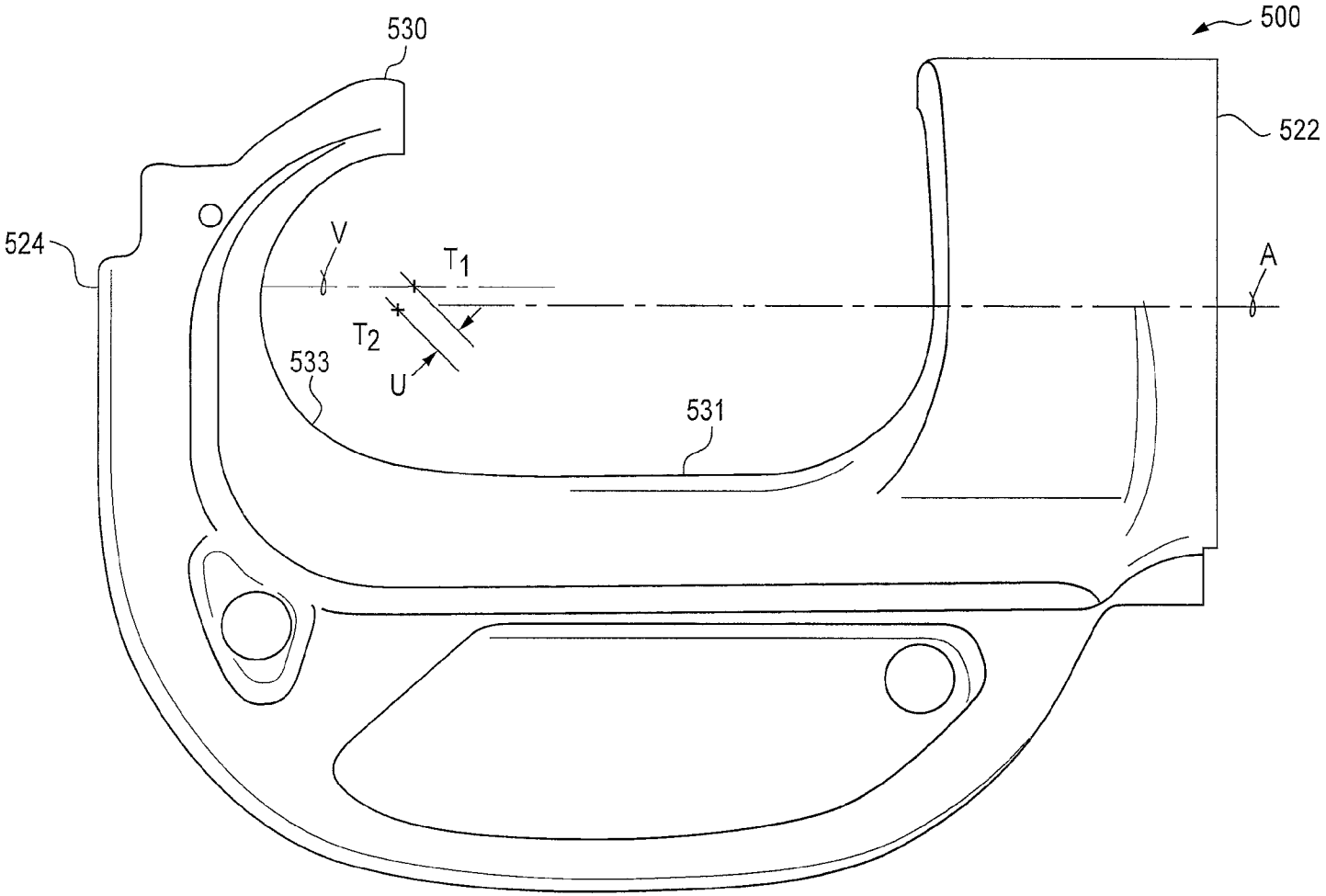
FIG. 7 is a side schematic view of an embodiment of another tool head in accordance with the present subject matter illustrating the tool head in a representative unloaded state.

Referring to FIG. 7, another embodiment of a tool head 500 in accordance with the present subject matter is shown. The tool head 500 may include some or all of the various structural features of the previously noted tool heads 100, 200, and/or 300. The tool head 500 shown in FIG. 7 is depicted in an unloaded state. FIG. 7 illustrates the tool head 500 having an arcuate crimping face 533 defined by a center point $T_1$. Upon placing the tool head 500 in a loaded state, region(s) of the tool head 500 that define the crimping face 533 are deflected such that the center point of the crimping face 533 is deflected to center point $T_2$. The center point $T_2$ intersects the extension axis A. Therefore, the dimensional change and location shift of the crimping face 533 center point from $T_1$ to $T_2$ as the tool head reaches its loaded state, can be characterized as a center point shift U.

The change in configuration of the tool head 500 when comparing the crimp face 533 in an unloaded state to a loaded state can also be characterized by reference to a shift in a center axis defined by the crimp face 533 relative to the extension axis A. The center axis of the crimp face 533 is depicted in FIG. 7 as axis V. Axis V generally bisects the crimp face 533 and is parallel to the extension axis A. When the tool head 500 is in an unloaded state, the center axis V intersects the center point $T_1$. Upon placing the tool head 500 in a loaded state, the center axis V intersects the center point $T_2$. As previously noted, the center point $T_2$ lies along the extension axis A. And thus, upon placing the tool head 500 in a loaded state, the center axis V is displaced towards, and in many embodiments is collinear with, the extension axis A.

The present subject matter also provides crimp tools and press tools (generally and collectively referred to as press tools herein) which utilize the noted deflection compensating tool heads. Generally, the press tools comprise a frame which includes the noted tool head and a hydraulic cylinder supported by and affixed to the frame. The tools also include a piston movably disposed in the cylinder. The piston defines a piston face and an opposite distal end which upon piston displacement, extends outwardly from the hydraulic cylinder. The tools also typically include a ram die holder engaged with the distal end of the piston. The ram die holder defines a second crimp face and is typically accessible in the work region defined by the tool head. Upon application of a crimping or pressing load, the tool head deflects to an extent such that the first and second crimp faces are aligned. Additional details of the tools are described in association with FIGS. 8-12.

In certain embodiments, the deflection compensating tool heads, assemblies, and/or related strategies could potentially reduce the required stroke of the tool. Such stroke reductions could be possible so long as the loading and/or unloading of the workpiece is not restricted. Specifically, in certain embodiments, the tool heads could be configured that would require a shorter stroke, such as a stroke that is reduced by about 5% for example. Less stroke results in shorter operation time and for a manually operated tool, many result in one or two less cycles of the hand pump.

Deflection Compensating Engagement Assemblies

Figure 8:
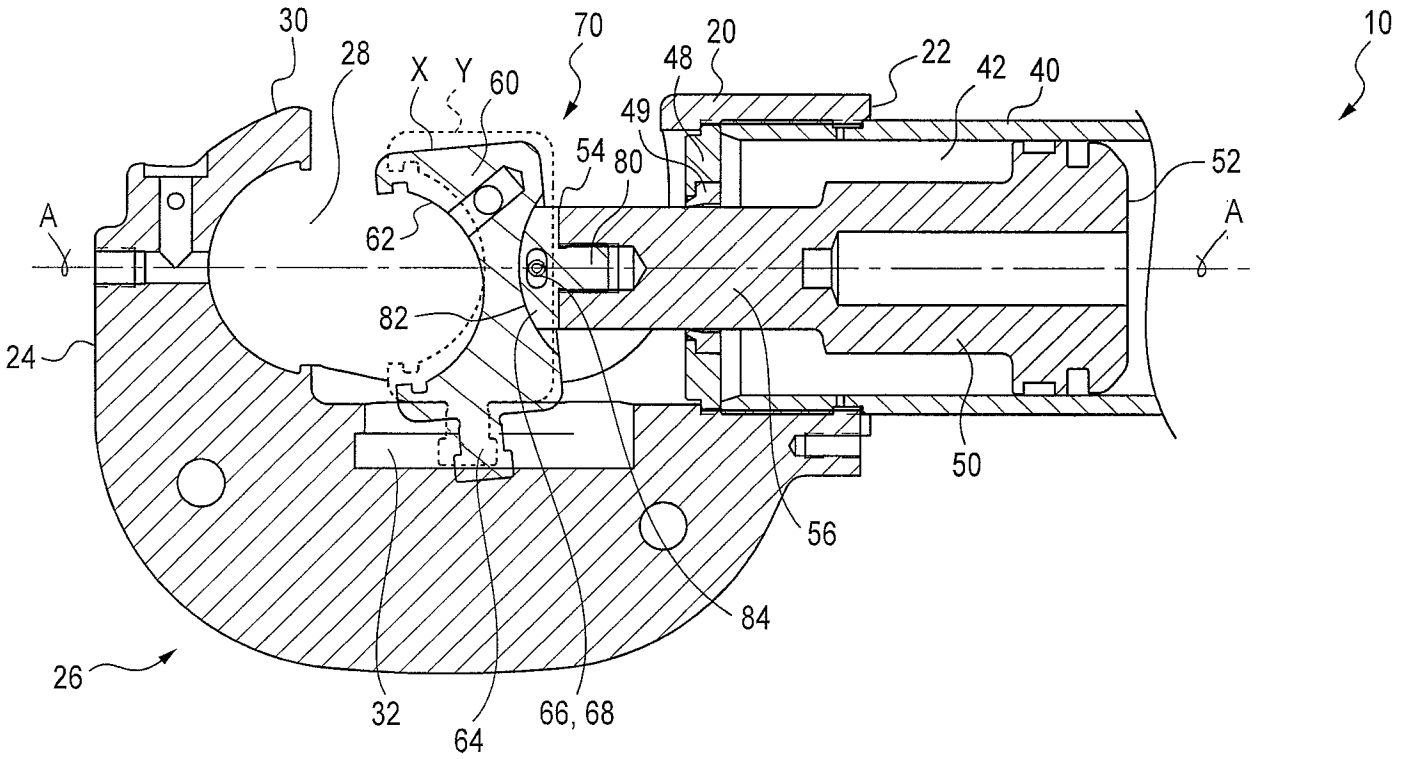
FIG. 8 is a schematic cross sectional view of a head portion of another embodiment of a crimp tool in accordance with the present subject matter.
Figure 9:
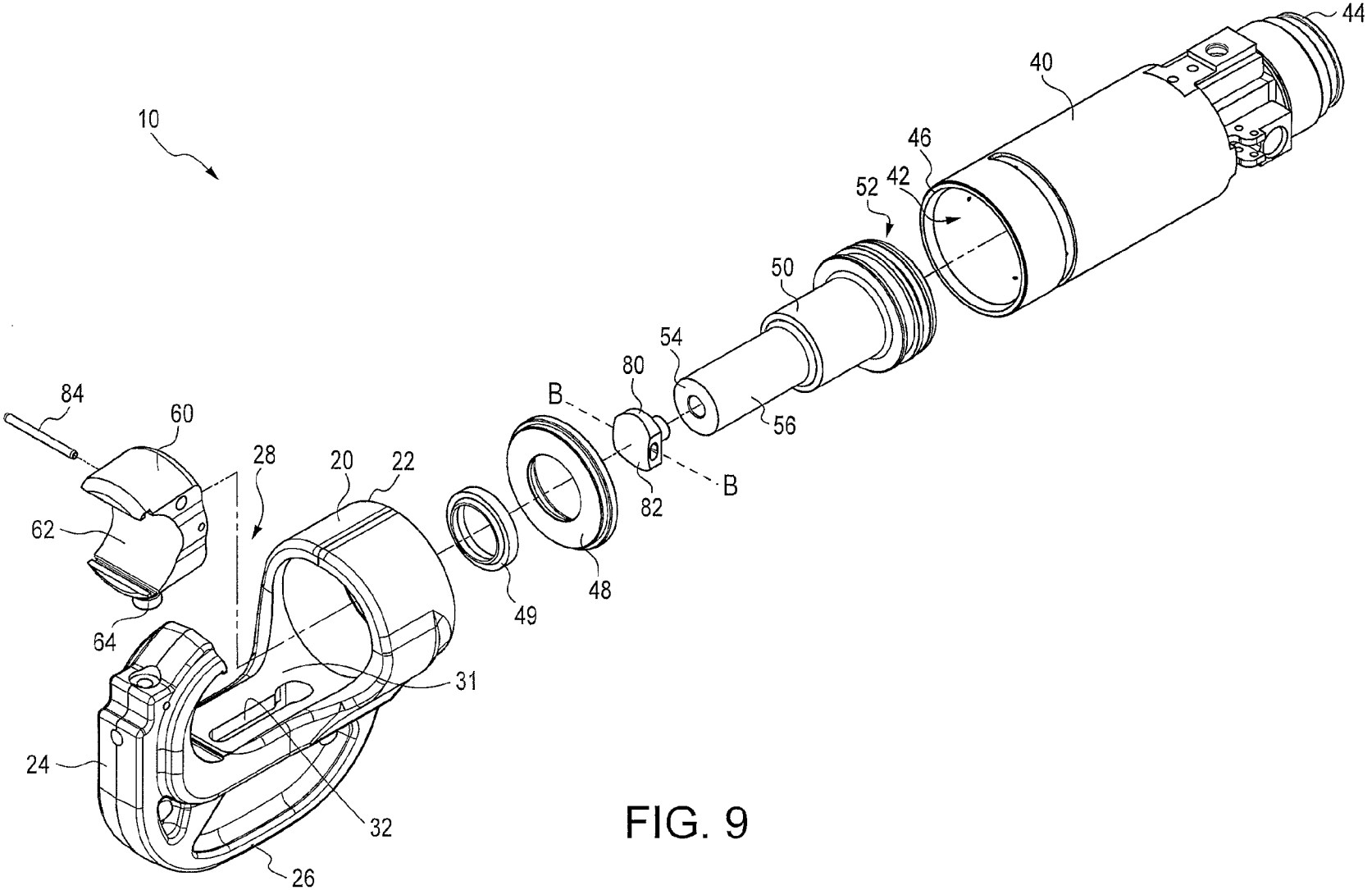
FIG. 9 is an exploded view of a head portion of the crimp tool depicted in FIG. 8 in accordance with the present subject matter.

FIGS. 8 and 9 illustrate a crimp tool 10 in accordance with the present subject matter. The crimp tool 10 comprises a frame 20, a hydraulic cylinder 40, a piston 50 movably positionable within the cylinder 40, a ram die holder 60, an engagement assembly 70 (see FIG. 8), and a piston tip 80. All of these components and others are described in greater detail herein.

Referring further to FIGS. 8 and 9, the frame 20 defines a proximal end 22 and an opposite distal or "head" end 24. The frame 20 also includes a C-frame head 26. The frame 20 and particularly the C-frame head 26 define a work region 28. The frame 20 also defines a frontwardly directed face 30. The frame 20 also defines an alignment track 32. The alignment track 32 extends along a frontwardly directed rear wall 31 of the C-frame head and is accessible in the work region 28.

The hydraulic cylinder 40 defines a proximal end 44 and an opposite distal end 46. The hydraulic cylinder also defines a chamber 42 in which the piston 50 is movably disposed. The hydraulic cylinder 40 comprises an end plate 48 typically disposed adjacent the distal end 46. One or more hydraulic seals 49 are provided to seal around a piston ram member 56 described in greater detail.

The piston 50 defines a piston face 52 and an opposite distal end 54. Upon assembly and incorporation of the piston 50 in the cylinder 40, the piston face 52 is directed toward the proximal end 44 of the cylinder 40. The piston ram member 56 extends at least partially between the piston face 52 and the piston end 54. The piston 50 is movably disposed in the cylinder 40 and can be linearly displaced along an extension axis A. As will be appreciated, upon administration of hydraulic fluid under pressure in the chamber 42 of the cylinder 40, force is exerted upon the face 52 of the piston 50, thereby displacing the piston along axis A toward the work region 28 of the C-frame head 26.

The ram die holder 60 defines a crimping face 62, a projection member 64, a receiving region 66, and an arcuate contacting surface 68. The crimping face 62 typically provides a desired profile for a crimping operation. The crimping face 62 may be configured to accept inserts for pressing or crimping. The projection member 64 is typically in the form of an outwardly extending member which extends outward from the die holder 60 and which is received and slidingly disposed in the previously noted alignment track 32 defined in the frame 20. The receiving region 66 is generally a recessed region defined in the ram die holder 60 which is directed toward the piston 50 and particularly, toward the distal end 54 of the piston or the piston tip 80. The arcuate contacting surface 68 is generally located at least partially within the receiving region 66.

In certain embodiments, the crimp tool 10 also comprises a piston tip 80 which is disposed at the distal end 54 of the piston 50. The piston tip 80 defines an arcuate face 82. The piston tip 80 can in certain embodiments be pressed onto the distal end 54 of the piston 50. However, the present subject matter includes a wide array of affixment configurations. The present subject matter also includes configurations in which the piston tip 80 is integrally formed with the piston 50.

In particular versions of the present subject matter, the arcuate face 82 of the piston tip 80 is continuous and free of apertures, holes, or other surface discontinuities. Providing a continuous surface for the entirety of the face 82 promotes distribution of forces between the piston tip 80 and the ram die holder 60 and reduced wear between these components.

The ram die holder 60 is movably affixed to the piston 50, and particularly to the distal end 54 of the piston 50, by an engagement assembly 70. For embodiments of the crimp tool 10 using the piston tip 80, the ram die holder 60 is movably affixed to the piston tip 80. The engagement assembly 70 provides for movement of the ram die holder relative to the piston. The engagement assembly 70 includes an arcuate face surface which is provided by either the distal end 54 of the piston 50, or if a piston tip 80 is used, by the arcuate face 82 of the piston tip 80. The engagement assembly 70 also includes the arcuate surface 68 which is provided at least partially within the receiving region 66 of the ram die holder 60. The two arcuate surfaces, i.e., (i) that of the piston end or piston tip, and (ii) that of the ram die holder, are configured to match one another. For example if the arcuate surface of the piston end/tip is convex, then the arcuate surface of the receiving region of the ram die holder is concave; and vice versa. As noted, the engagement assembly 70 enables the ram die holder 60 to adopt a plurality of positions relative to the piston 50. For example, referring to FIG. 8, the die holder 60 can be articulated from a first position shown by the dashed outline Y, to a second position shown by the solid outline X. The second position X is an example of a position reached by the die holder 60 during application of force such as during crimping, and resulting from deflection by the C-frame head 26.

In certain embodiments, the ram die holder 60 is affixed to the piston tip 80 by a fastener member 84. The ram die holder 60 defines a first aperture, and the piston tip 80 defines a second aperture. Upon insertion of the arcuate face 82 of the piston tip 80 into the receiving region 66 of the ram die holder 60, the arcuate face 82 of the piston tip 80 contacts the arcuate face 68 of the ram die holder 60. Upon placement of the piston tip 80 into the receiving region 66 of the ram die holder 60, and alignment of the first and second apertures, the fastener member 84 is inserted through the apertures. This configuration enables the ram die holder 60 to be pivotally positionable about an axis defined by the center of the cylindrical face 82. The fastener 84 retains and prevents disengagement between the piston tip 80 and the ram die holder 60. Additional securement provisions can be associated with the inserted fastener 84 to thereby securely affix the piston tip 80 with the ram die holder 60. It will be appreciated that if a piston tip 80 is not used, the distal end 54 of the piston 50 is associated with and affixed to the ram die holder 60 using the noted apertures and fastener member 84. The present subject matter includes a wide array of fastener components and techniques for affixing the ram die holder to the piston.

Figure 10:
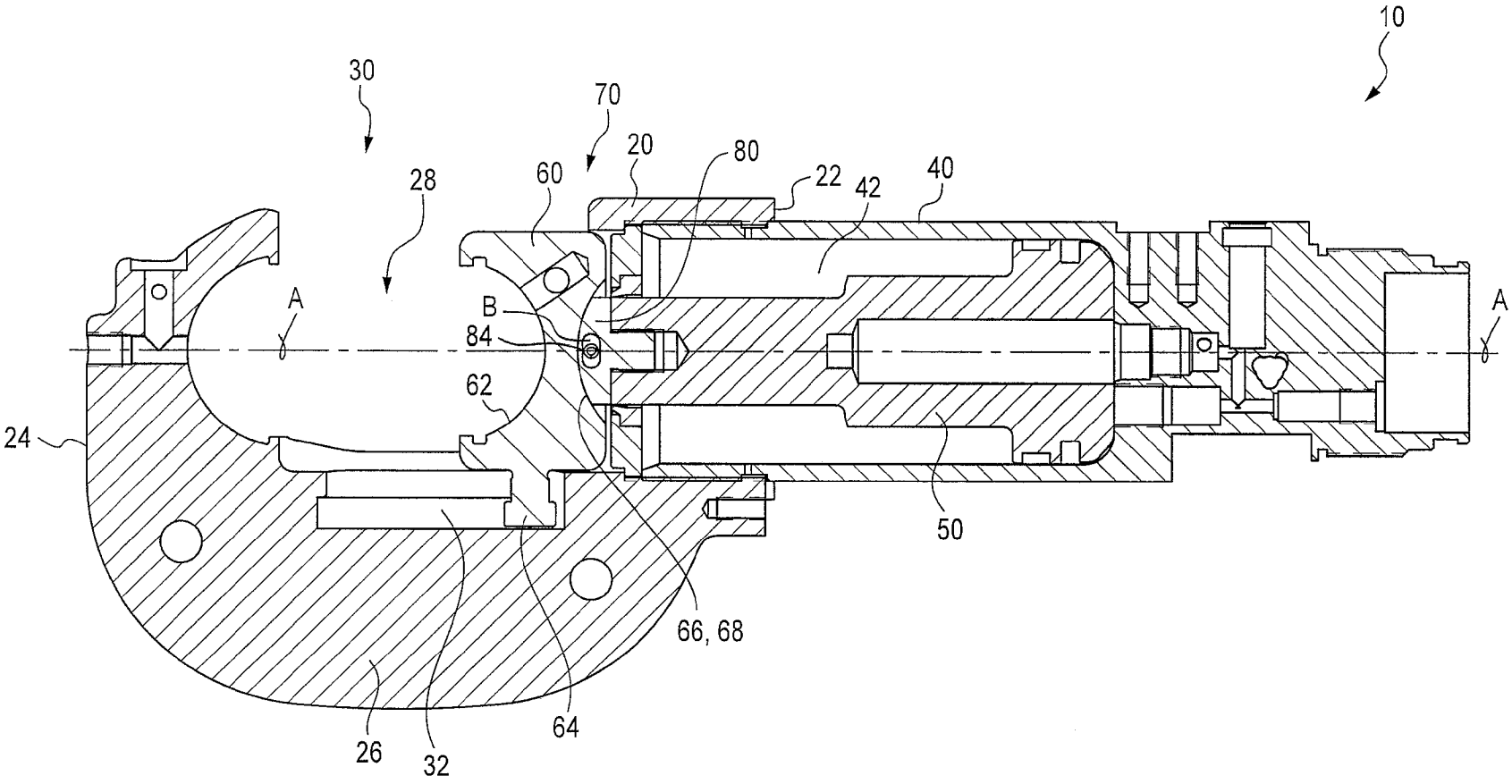
FIG. 10 is a schematic cross sectional view of the crimp tool of FIG. 8 in a fully retracted position.

FIG. 10 is a cross section of the crimp tool 10 in a fully retracted position. In this fully retracted position in which no stress is placed upon the C-frame head 26, the extension axis A of the piston 50 is generally parallel with a center axis of the crimp tool 10, or at least coplanar with a plane bisecting the crimp tool 10.

Figure 11:
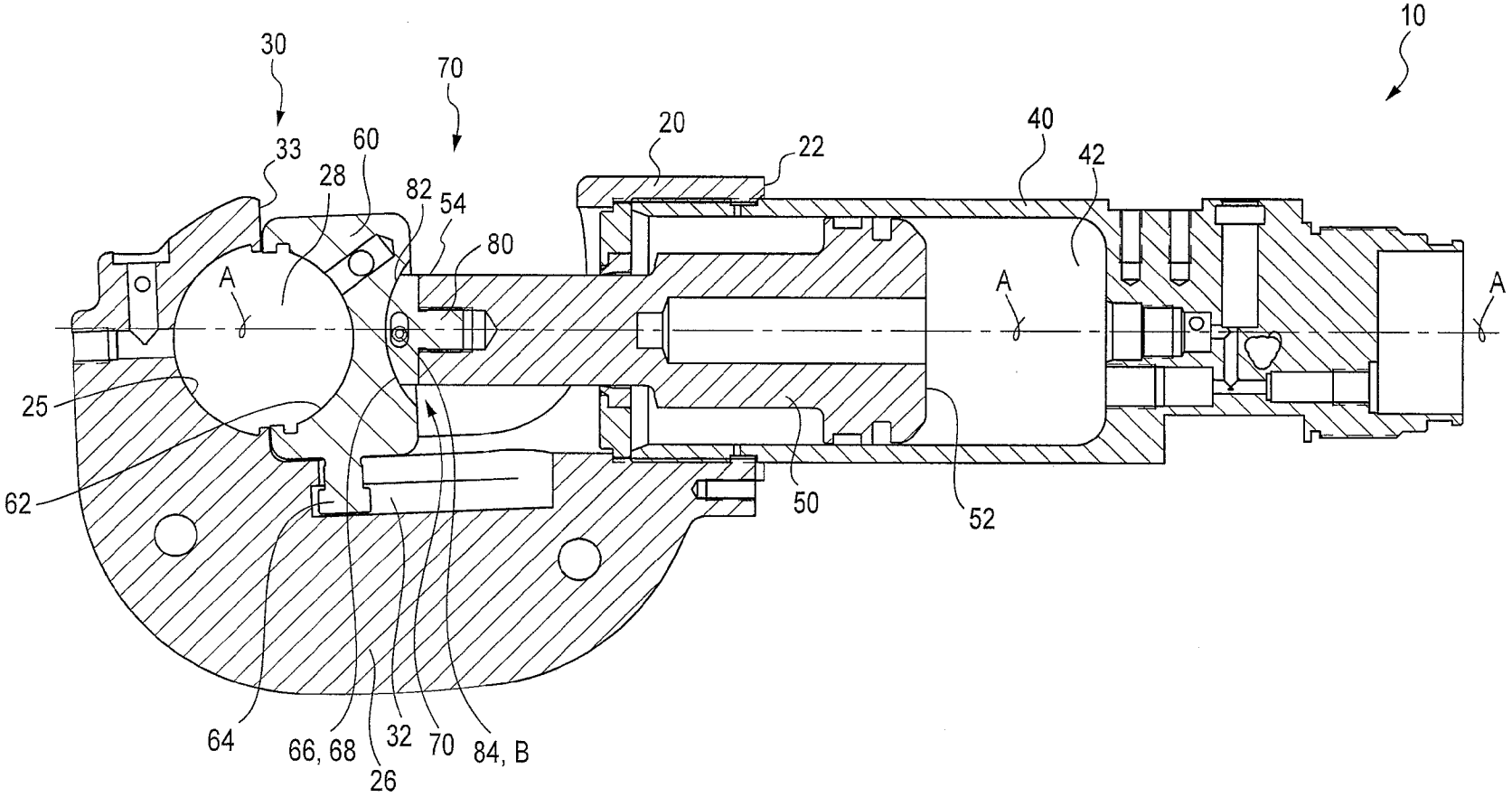
FIG. 11 is a schematic cross sectional view of the crimp tool depicted in FIG. 8 in a fully extended position and under moderate deflection.

FIG. 11 illustrates the crimp tool 10 at a fully extended position, and upon application of force to the die holder 60. Application of force to the die holder 60 results from linear displacement of the piston 50 toward the C-frame head 26 caused by entry of hydraulic fluid under relatively high pressure into the chamber 42 of the cylinder 40. It will be appreciated that the crimp tool 10 may include a hydraulic pump and motor, or utilize a modular configuration and releasably engage a conduit or source of high pressure fluid. FIG. 11 shows the C-frame head 26 of the frame 20 undergoing a moderate extent of deflection. As illustrated in FIG. 11, application of force upon the piston 50, and then transmittance of that force to the die holder 60, and subsequently to the C-frame head 26, results in deformation of the C-frame head 26. Generally, when dies are in the die holders, dies contact each other and the die holders do not contact each other. However, maintenance of a proper crimp profile, i.e., the orientation of the crimping face 62 of the ram die holder 60 to the crimping face 25 of the C-frame head 26, is accomplished due to articulation of the ram die holder 60 relative to the piston tip 80. As previously described, such articulation is provided for by the engagement assembly 70. In the particular version depicted, movement occurs along the interface between the arcuate face 68 of the ram die holder 60 and the arcuate face 82 of the piston tip 80. Such movement occurs as the ram die holder 60 nears its fully extended position at which the ram die holder 60 may contact a stop surface 33 of the C-frame head 26, or at which a crimp is completed. With dies, a lug, and wire in the tool, deflection and alignment occur as force is applied, i.e., force is applied earlier as compared to when the tool head is empty. For embodiments of tool heads in which the dies can be positioned into alignment, the dies contact each other and the force of the tool increases to a maximum force permitted by the relief valve which controls hydraulic pressure.

Figure 12:
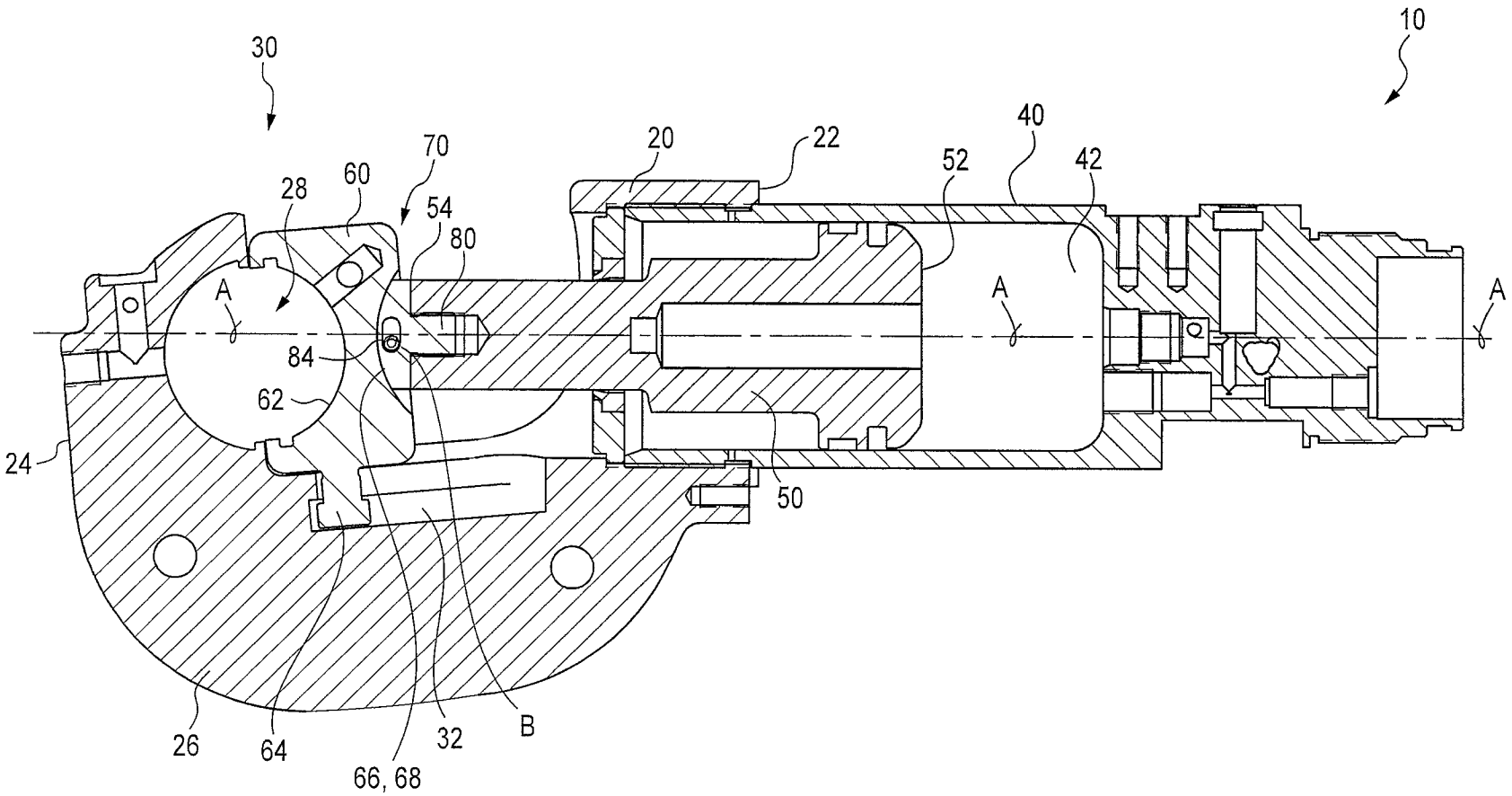
FIG. 12 is a schematic cross sectional view of the crimp tool shown in FIG. 8 in a fully extended position and under significant deflection.

FIG. 12 depicts the C-frame head 26 undergoing a significant extent of deflection. Again, articulation between the ram die holder 60 and the piston tip 80 compensates for the deflection in the C-frame head.

The present subject matter also provides various methods of compensating for deflection occurring in a C-frame head of a press tool during a pressing or crimping operation. The methods generally comprise providing a press tool that includes a C-frame head and a collection of dies. The C-frame head is configured, typically prior to incorporation in the tool, such that upon application of a load as would be applied during a typical pressing or crimping operation, the tool head deflects to a position such that the collection of dies are aligned to thereby enable full die closure. As previously explained herein, at full die closure, contact between opposing faces of adjacent dies occurs on both sides of a fitting or assembly. This is shown for example in FIG. 6C. As previously explained, at full die closure, the collection of dies are positioned such that opposing faces of die ends of adjacent dies contact each other and are free of gaps or spacing. In many embodiments, the C-frame head is configured such that upon being in a loaded state, a center axis defined by a crimp face is displaced towards an extension axis of the tool. In certain embodiments, the center axis is displaced so that the axis is collinear with the extension axis.

The various deflection compensating engagement assemblies and tools utilizing such assemblies of the present subject matter provide several benefits. Greater deflection of the C-frame head is allowed as a result of the pivoting or articulating connection. The tool(s) and specifically the C-frame head can be further optimized for weight.

Even without weight optimization, all C-frame designs deflect to some extent during typical loading and/or tool use. Thus, the present subject matter also provides benefits over existing tools because a greater surface area and contact pattern is made between the piston and ram die holder. This results in reduced component wear and reduced likelihood of failure due to uneven force distributions.

Additionally, the connection between the ram die holder and piston reduces a slide load as the crimp is completed. Thus, these components are less stressed and the likelihood of failure is reduced. This reduces the side load on the piston to housing/bore also. A reduced side load also decreases wear and in certain assemblies can simplify the piston/bore alignment.

Many other benefits will no doubt become apparent from future application and development of this technology.

All patents, applications, standards, and articles noted herein are hereby incorporated by reference in their entirety.

The present subject matter includes all operable combinations of features and aspects described herein. Thus, for example if one feature is described in association with an embodiment and another feature is described in association with another embodiment, it will be understood that the present subject matter includes embodiments having a combination of these features.

As described hereinabove, the present subject matter solves many problems associated with previous strategies, systems and/or devices. However, it will be appreciated that various changes in the details, materials and arrangements of components, which have been herein described and illustrated in order to explain the nature of the present subject matter, may be made by those skilled in the art without departing from the principle and scope of the claimed subject matter, as expressed in the appended claims.

What is claimed is:

1. A C-frame tool head for affixment to a press tool having a ram, piston, or force producing member, the tool head defining a proximal end and an opposite distal end, and upon affixment to the press tool, the tool head defines an extension axis corresponding to movement of the ram, piston, or force producing member, the tool head comprising:

a body portion;

a hook member extending from the body portion, the hook member defining a crimp face directed toward the proximal end of the tool head, the crimp face defining a center axis that bisects the crimp face;

wherein upon the tool head being in an unloaded state, the center axis is spaced from the extension axis, and upon being in a loaded state, the center axis is displaced towards the extension axis;

wherein the center axis defined by the crimp face extends parallel to the extension axis when the tool head is in the unloaded state.

2. The C-frame tool head of claim 1 wherein upon being in a loaded state, the center axis is collinear with the extension axis.

3. The C-frame tool head of claim 1 wherein the body portion defines a rear wall and the hook member further defines an access face, the tool head further comprising:

a movable die holder which is linearly displaceable along the rear wall upon movement of the ram, piston, or force producing member;

a first die received in the crimp face, the first die defining a die face extending between a first end proximate the access face, and a second end proximate the rear wall;

a second die supported by the movable die holder, the second die defining a die face extending between a first end proximate the access face, and a second end proximate the rear wall;

wherein upon the tool head being in the loaded state, the first and second dies are in a state of full die closure.

4. The C-frame tool head of claim 3 wherein upon the tool head being in the unloaded state, an opposite end spacing between ends of the first and second dies exists within a range of from 3 mm to 0.1 mm.

5. The C-frame tool head of claim 3 wherein upon the tool head being in the unloaded state, a bias angle between the first and second dies exists within a range of from 15 degrees to 0.1 degrees.

6. A C-frame tool head and at least two crimping inserts, the tool head defining a proximal end and an opposite distal end, the tool head comprising:

a body portion;

a hook member extending from the body portion, the hook member defining a crimp face directed toward the proximal end of the tool head;

a first crimping insert configured to be received along the crimp face, the first crimping insert defining a first end and a second end;

a second crimping insert defining a first end and a second end, the second crimping insert positionable with the first crimping insert to thereby form a crimping profile;

wherein (i) upon positioning of the first and the second crimping inserts such that one of the first and the second ends of the first crimping insert contacts one of the first and the second ends of the second crimping insert, and the tool head being in an unloaded state, an opposite end spacing is defined between the other ends of the first crimping insert and the second crimping insert; and (ii) upon the tool head being in a loaded state the opposite end spacing is within a range of from 0.1 mm to 3 mm.

7. A C-frame tool head and at least two crimping inserts, the tool head defining a proximal end and an opposite distal end, the tool head comprising:

a body portion;

a hook member extending from the body portion, the hook member defining a crimp face directed toward the proximal end of the tool head;

a first crimping insert configured to be received along the crimp face, the first crimping insert defining a first end and a second end;

a second crimping insert defining a first end and a second end, the second crimping insert positionable with the first crimping insert to thereby form a crimping profile;

wherein (i) upon positioning of the first and the second crimping inserts such that one of the first and the second ends of the first crimping insert contacts one of the first and the second ends of the second crimping insert, and the tool head being in an unloaded state, an opposite end spacing is defined between the other ends of the first crimping insert and the second crimping insert; and (ii) upon the tool head being in a loaded state, the other ends of the first crimping insert and the second crimping insert contact each other and the opposite end spacing is zero;

wherein upon the tool head and inserts being in state (i), a bias angle between the first and the second crimping inserts exists within a range of from 15 degrees to 0.1 degrees.

8. A press tool comprising:

a frame including a C-frame tool head defining a work region and a first crimp face, the first crimp face defining a center axis that bisects the first crimp face;

a hydraulic cylinder supported by and affixed to the frame;

a piston movably disposed in the cylinder, the piston defining a piston face and an opposite distal end, the distal end extending outward from the hydraulic cylinder, the piston defining an extension axis;

a ram die holder engaged with the distal end of the piston, the ram die holder including a second crimp face, the ram die holder accessible in the work region defined by the tool head;

wherein upon application of a crimping load to the first and second crimp faces by the piston, the tool head is configured to deflect to an extent such that the first and second crimp faces are aligned;

wherein the center axis defined by the first crimp face extends parallel to the extension axis when the tool head is in the unloaded state.

9. The press tool of claim 8 wherein the C-frame tool head includes a hook member defining an access face, the C-frame tool head also defines a rear wall, the ram die holder being linearly displaceable along the rear wall upon movement of the piston, the press tool further comprising:

a first die received in the crimp face, the first die defining a die face extending between a first end proximate the first access face, and a second end proximate the rear wall;

a second die supported by the ram die holder, the second die defining a die face extending between a first end proximate the first access face, and a second end proximate the rear wall.

10. The press tool of claim 9 wherein upon partial die closure, an opposite end spacing exists within a range of from 3 mm to 0.1 mm.

11. The press tool of claim 9 wherein upon partial die closure, a bias angle exists within a range of from 15 degrees to 0.1 degrees.

12. The press tool of claim 8 wherein upon the tool head being in an unloaded state, the center axis is spaced from the extension axis, and upon being in a loaded state, the center axis is collinear with the extension axis.

13. A press tool comprising:

a frame including a C-frame head defining a work region, the C-frame head including a body portion, a hook member extending from the body portion, the hook member defining a crimp face directed toward a proximal end of the head, the crimp face defining a center axis that bisects the crimp face;

a linearly displaceable piston having a distal end, the piston extendable along an extension axis;

a piston tip engaged with the distal end of the piston;

a ram die holder engaged with the piston tip, the ram die holder accessible in the work region defined by the C-frame head;

wherein the ram die holder is movably affixed to the piston tip, the piston tip defines a first arcuate face surface directed toward the ram die holder, and the ram die holder defines a receiving region with a second arcuate face surface, the first arcuate face surface of the piston tip contacting the second arcuate face surface of the ram die holder, and the first arcuate face surface is continuous and free of apertures;

wherein upon the C-frame head being in an unloaded state, the center axis is spaced from the extension axis, and upon being in a loaded state, the center axis is displaced toward the extension axis;

wherein the center axis defined by the crimp face extends parallel to the extension axis when the tool head is in the unloaded state.

14. The press tool of claim 13 wherein, the ram die holder defines a crimping face, and the ram die holder is movably affixed to the piston tip so that the crimping face can be articulated to a plurality of different positions relative to the extension axis.

15. The press tool of claim 13 wherein, the ram die holder is pivotally positionable about an axis transverse to the extension axis.

16. The press tool of claim 13 wherein the C-frame head defines an alignment track, the ram die holder including at least one projection slidably disposed in the alignment track.

17. The press tool of claim 13 wherein the first arcuate face surface of the piston tip is convex and the second arcuate face surface of the ram die holder is concave.

18. The press tool of claim 13 wherein the first arcuate face surface of the piston tip is semi-cylindrical, and the second arcuate face surface of the ram die holder is semi-cylindrical.

19. The press tool of claim 13 wherein the first arcuate face surface of the piston tip is semi-spherical, and the second arcuate face surface of the ram die holder is semi-spherical.

20. The press tool of claim 13 wherein the ram die holder is affixed to the piston tip by a fastener member.

21. The press tool of claim 13 wherein the ram die holder is pivotally positionable about an axis defined by the center of the first arcuate face surface of the piston tip.

22. A method of compensating for deflection occurring in a C-frame head of a press tool during a pressing operation, the method comprising:

providing a press tool including a C-frame head and a plurality of dies, the C-frame head defining an extension axis corresponding to movement of a ram, piston, or force producing member, the C-frame head including a body portion, a hook member extending from the body portion, the hook member defining a crimp face directed toward a proximal end of the head, the crimp face defining a center axis that bisects the crimp face;

configuring the C-frame head such that upon application of a load as would be applied during the pressing operation, the tool head deflects to a position such that the plurality of dies are aligned to thereby enable full die closure, whereby upon the C-frame head being in an unloaded state, the center axis is spaced from the extension axis, and upon being in a loaded state, the center axis is displaced toward the extension axis, and the center axis defined by the crimp face extends parallel to the extension axis when the tool head is in the unloaded state.

23. The method of claim 22 wherein at full die closure, contact between opposing faces of adjacent dies occurs on both sides of a fitting.

24. The method of claim 22 wherein at full die closure, the plurality of dies are positioned such that opposing faces of die ends of adjacent dies are free of gaps.

* * * * *